United States Patent [19]

Cota

[11] 4,250,828

[45] Feb. 17, 1981

[54] MARINE ANCHOR

[75] Inventor: Alain Cota, Paris, France

[73] Assignee: Association pour le Transport et l'Affretement-Etablissement Walon S.A., Boulogne-Billancourt, France

[21] Appl. No.: 972,816

[22] Filed: Dec. 26, 1978

[30] Foreign Application Priority Data

Dec. 23, 1977 [FR] France ..... 77 39020
Nov. 10, 1978 [FR] France ..... 78 31847

[51] Int. Cl.[3] ..... B63B 21/00

[52] U.S. Cl. ..... 114/307; 114/306; 114/303

[58] Field of Search ..... 114/294–310

[56] References Cited

U.S. PATENT DOCUMENTS

| | | | |
|---|---|---|---|
| 1,974,933 | 9/1934 | Taylor | 114/304 |
| 2,267,657 | 12/1941 | Kroukovsky | 114/307 |
| 2,380,119 | 7/1945 | Northrop | 114/309 |
| 3,428,014 | 2/1969 | Smith | 114/305 |
| 3,882,665 | 7/1974 | Hungerford | 114/310 |

FOREIGN PATENT DOCUMENTS

| | | | |
|---|---|---|---|
| 136087 | 9/1947 | Australia | 114/304 |
| 2324892 | 12/1974 | Fed. Rep. of Germany | 114/303 |

*Primary Examiner*—Trygve M. Blix
*Assistant Examiner*—D. W. Keen
*Attorney, Agent, or Firm*—Brisebois & Kruger

[57] ABSTRACT

An anchor in which the flukes pivot on the shank about independent axes which converge toward the anchor chain end of the shank. Lugs at the base of shank provide for mounting the pivots. The anchor is reversible and has support plates on either side of its base which act as stops to limit the extent that the plate-like flukes can close toward each other as the anchor is set.

9 Claims, 6 Drawing Figures

MARINE ANCHOR

BACKGROUND OF THE INVENTION

The present invention relates to a marine anchor.

Better and higher performance standards are being demanded of marine anchors due to the increased needs of large ships, offshore drilling platforms, and anchored floating installations.

In general, the anchors presently used are of a reversible type (can anchor from either side) and consist of a shank fixed by its front portion to a chain and having on its rear portion a transverse pivot joint around which two generally coplanar flukes can pivot simultaneously, the flukes being more or less triangular in shape. When these anchors are placed on the bottom, their back end is raised, for instance by a base part of the anchor, and the two flukes tend under the influence of their weight to tilt forwardly toward the bottom around the pivot. A pull on the shank thus tends to drive the flukes into the sea bed.

The disadvantage of these known anchors is that when they are buried, they exert a basically upward strain on the sea bottom, which tends to lift up the thin layer of earth covering the feet resulting in a comparatively reduced anchorage force.

Anchors having the shape of a ploughshare, as for example in French Pat. No. 2,046,966, have already been designed in an attempt to increase the anchorage force. These anchors have the general shape of a ploughshare of generally triangular cross-section, its size increasing from the front end so that the side surfaces of the ploughshares are inclined to face the side and the top. These ploughshares are mounted on bars or on shanks, both pivotally and non-pivotally.

However, these latter anchors have not given complete satisfaction.

On the one hand, their side surfaces have more or less horizontal portions which also tend to lift the earth upwardly.

On the other hand, they are not reversible and must therefore either be provided with supplementary methods, for example a shank made of two pivoted portions, to enable them to be properly positioned on the bottom, or must be placed by special means such as floating cranes, ships, and floats, but with no guarantee that the proper positioning will always result.

Anchors mounted in a frame and having two pivoted flukes able to move freely around slightly convergent axes have also been suggested, as in U.S. Pat. No. 3,977,351. Such anchors are relatively complicated to build and do not yield a significantly increased anchorage force since the flukes which are poorly guided or, if pivoted between themselves, tend to position themselves in planes little different from each other, and the frame interferes with the digging in of the anchor.

Finally, as in U.S. Pat. No. 2,380,119, anchors have been suggested in which the two flukes are pivoted independently of each other around a common axis following the geometric axis of the anchor and mounted on a base, the shank itself being pivoted with respect to this base around an axis perpendicular to the preceding axis. This arrangement significantly increases the anchorage force and has all the advantages of reversibility. The disadvantage of these anchors is that they are more complicated to build and the flukes do not obtain maximum penetration.

SUMMARY OF THE INVENTION

An object of the present invention is to eliminate these disadvantages and to provide a reversible type of anchor which will be easy to build and have an increased anchorage force, and easier, more certain penetration.

Moreover, the anchors according to the invention can be easily placed in hawseholes as can the usual anchors with pivoted flukes. They are easy to withdraw and to set, and resist a tractive force better than ploughshare type anchors.

The invention has as its object a marine anchor of the type having a shank, a support element or base connected to the shank, two flukes pivoted independently of each other on the support so as to permit the flukes, when they are tilted with respect to the base, to form a diminishing angle between themselves, characterized by the fact that the flukes are pivoted without play with respect to the support element around two axes converging toward the front of the shank at an acute angle.

In one preferred embodiment, a geometric line connecting the penetrating point of the fluke with the pivot axis of the fluke forms an angle of between 30 and 60 degrees with the pivot axis.

According to one advantageous characteristic of the invention, the closing angle of the flukes, that is, the angle that the faces of the two flukes make between themselves in a transverse plane perpendicular to the shank, when the two flukes form the smallest possible angle, is between 90 and 130 degrees, preferrably about 110 degrees.

Advantageously, the angle between the pivot axis of one foot and the shank is between 15 and 30 degrees.

Results show that this will yield an anchor which is very easy to build and which still provides a particularly good anchorage resistance.

In one preferred embodiment of the anchor, it has a single piece shank having a rear base whose side faces have lugs supporting the pivot axes of the flukes, while the upper and lower faces of the base have support plates making an angle of preferrably about 20 degrees with the shank, converging toward the front so as to tilt the flukes toward the front when one of the faces is placed on the ground.

This base may advantageously be so made as to not only raise the back of the anchor when the latter is placed on the bottom and so permit the front ends of the flukes to bite into the ground, but also to form stops to limit the movement of the feet around their pivot axes.

The flukes can be smooth or ribbed plane surfaces or curved surfaces. They can be made either from a piece of sheet iron of constant thickness, or from one whose thickness increases from front to back.

Other advantages and characteristics of the invention will become apparent from the following description, which is in no way limiting, and from the attached drawings.

DETAILED DESCRIPTION

The anchor according to the invention has an elongated shank 1 united to or integral with a rear base 2. Shank 1 has at its front end an opening 3 for connecting the anchor chain.

Figure 2:
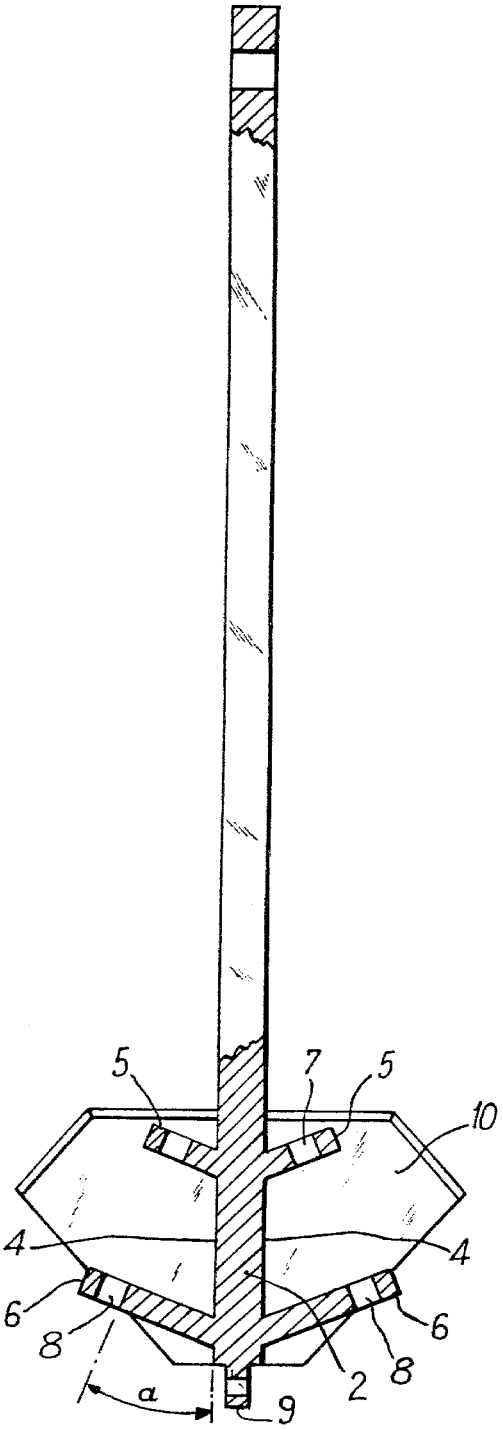
FIG. 2 shows a view from above in partial section of the shank-base.

Base 2, whose transverse section is shown in FIG. 2, is formed by an enlargement of the shank 1.

Figure 3:
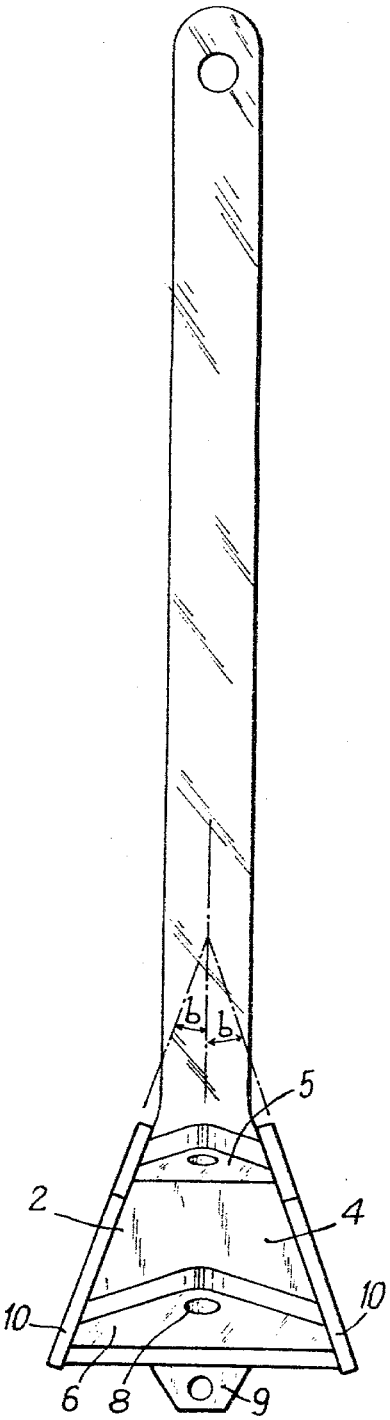
FIG. 3 shows a side view of the shank-base of FIG. 2.
Figure 5:
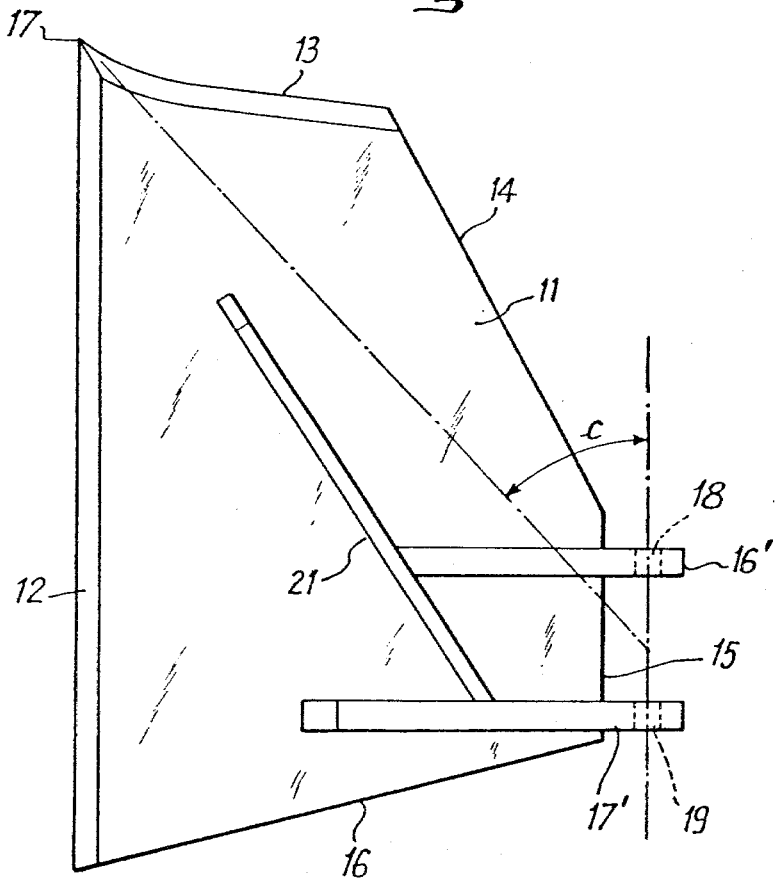
FIG. 5 shows a plane view of a fluke.
Figure 6:
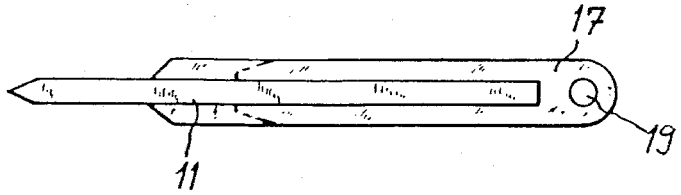
FIG. 6 is a rear view of the fluke of FIG. 5.

The side faces 4 of the base have a pair of front lugs 5 and a pair of rear lugs 6 provided respectively with aligned openings 7 and 8 for mounting pivot axles 20. These lugs 6 and 7 are inclined with respect to the plane of the shank so that angle a (FIG. 2) between the axis of openings 7, 8 and the plane of the shank is advantageously between 15 and 30 degrees and preferrably about 24 degrees. The rear face of the base 2 also has a lug 9 with a suitable opening for the passage of a lifting rope. The lower and upper edges of the base, which diverge toward the rear, are each covered by a polygonal support plate 10 making an angle b of preferrably about 20 degrees with the axis of the shank, as shown at FIG. 3.

Flukes 11 of the anchor take the shape of an irregular flat pentagon with a longer outer edge 12, approximately parallel to pivot axle 20 (the pivot axis of the fluke), a shorter front edge 13, an inside front edge 14, an inner edge 15 which is the shortest of the edges and which extends parallel to the pivot axis beside it, and a rear edge 16. The penetrating point 17 is common to edges 12 and 13 which are beveled and angle c formed between the pivot axis of a fluke and the line connecting point 17 to the median portion of the pivot axis is approximately 45 degrees. It should be at least 30 degrees but no more than 60 degrees.

Edges 12 and 13 can advantageously be sharpened or beveled and point 17 pronounced to facilitate penetration into the sea bed.

Fluke 11 has two transverse mounting bars 16' and 17' with aligned openings 18 and 19 for the passage of a pivot axle or pin 20. The fluke can also have stiffening ribs such as 21 connected to the bars 16' and 17'.

Figure 1:
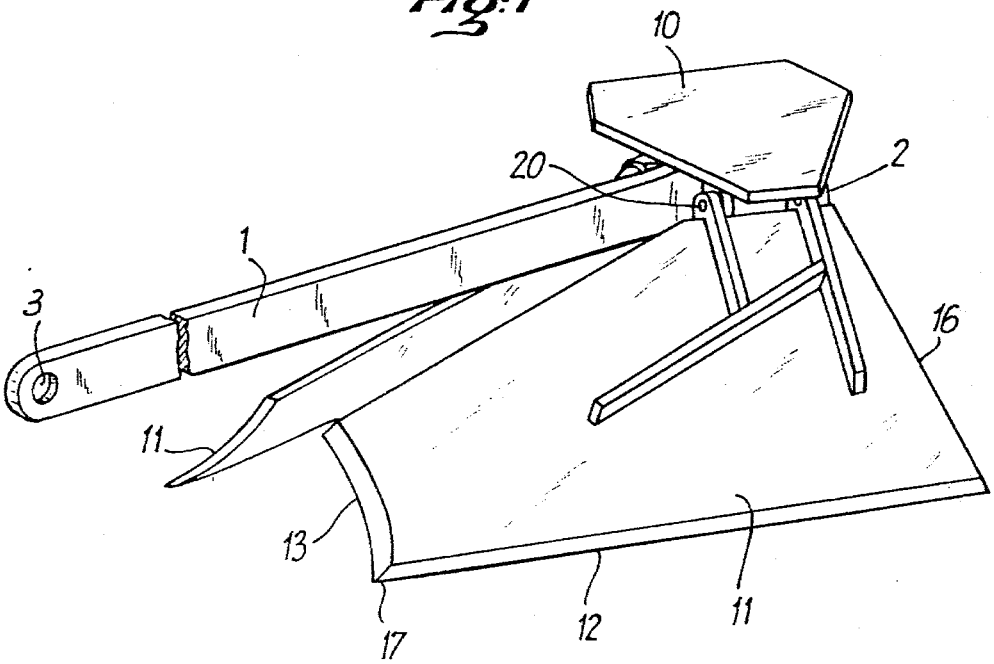
FIG. 1 shows a view in perspective of an anchor according to the invention.
Figure 4:
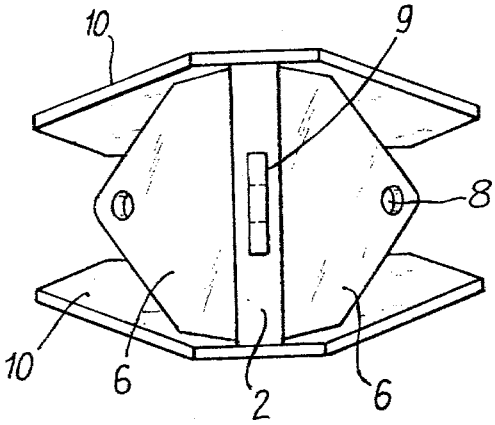
FIG. 4 shows a rear view of the shank.

Moreover, the movement of flukes 11 is limited. When the flukes approach each other, as shown in FIG. 1, their pivotal movement is limited by engaging against lower plate 10 (not visible in FIG. 1). In this position, the angle between the two flukes 11 is between 90 and 130 degrees and preferrably about 110 degrees in a transverse plane perpendicular to the shank.

The ratio of the length of the shank to the largest length dimension of the fluke is preferrably on the order of 1.4.

The anchor made according to the invention is completely reversible, top to bottom. Since the flukes can approach each other, it can easily be drawn into a hawsehole. During use, the anchor rests on a lower face 10 on the sea bottom, the flukes resting on the bottom in a nearly horizontal position. When the anchor chain, hooked to the end of shank 1, exerts a horizontal pull toward the front, points 17 tend to penetrate the ground. When, as a result, a small resistance to the pull occurs, the whole anchor tends to tilt down and toward the front and the flukes then actively penetrate the ground while decreasing the angle between themselves, until they abut against plate 10 which they enclose.

Since the angle between the flukes closes when there is a pull on the anchor, the flukes exert a pressure on the overlying sea bottom material which is not vertical but obliquely upward, toward the outside front. Consequently, there is a very significant anchorage resistance.

In one variation, the flukes may take other polygonal or rounded shapes and may include stiffening elements. Instead of being formed of flat pieces of iron plate, they may also be of varying thickness increasing from front to back. They can have smooth or ribbed plane surfaces or shaped surfaces. The pivot joints of the sides may be made in any way familiar to one skilled in the art.

The base may be reduced to a simple support piece holding the two pivots in which case it neither serves as an abutment nor causes the anchor to tilt. In this embodiment, the rear ends of the flukes can be supplied with ribs or bars which extend perpendicularly to the plane of the flukes so as to first raise the back of the flukes and cause them to tilt toward the front when the flukes rest on the ground and second, when the two bars of the two flukes come in contact, serve to limit the angular movement of the flukes toward each other.

Although one particular embodiment of the invention has been described, it is in no way limiting and the invention can take various modifications without departing from the basic principles.

What is claimed is:

1. A reversible marine anchor comprising a shank having a front and a rear, a base connected to the rear of the shank, two flukes, pivot means pivotally mounting said flukes independently of each other on said base for pivotal movement toward each other with respect to the base, to form a diminishing angle between themselves, wherein said pivot means comprises two axes respectively on opposite sides of the shank which converge toward each other and toward the front of the shank and each form an acute angle with the shank, so that as said flukes pivot toward each other surfaces thereof which face away from each other converge in a direction toward the front of the shank, said flukes pivoting toward each other and digging into the floor of the body of water where the anchor is used, in response to a pull along the shank of the anchor, said converging working faces creating a plow effect to enhance resistance to withdrawal of the anchor.

2. A marine anchor according to claim 1, wherein a geometric line extended between a penetrating point of each fluke to the pivot axis of the same fluke forms an angle of between 30° and 60° with the pivot axis.

3. A marine anchor according to claim 1, wherein the angle between the pivot axis of each fluke and the shank is between 15° and 30°.

4. A marine anchor according to claim 3, wherein said angle is approximately 24°.

5. A marine anchor according to any one of claims 1 to 4, wherein the angle between the flukes, when closed, is between 90° and 130°.

6. A marine anchor according to any one of claims 1 to 4, wherein the shank and the base are of one piece, said base having on its sides lugs which converge in pairs toward the front to hold the pivot axes of the flukes.

7. A marine anchor according to claim 6, wherein the base has on both its upper and lower faces, means for raising the back of the anchor when it is placed on the ground and providing abutments to the closing of the flukes, said means comprising, first and second support plates.

8. A marine anchor according to claim 7, wherein the angle between a support plate and the shank is approximately 20°.

9. A marine anchor according to claim 1, wherein each fluke has a generally pentagonal shape, with a long outer edge, a front edge forming, at its common apex with the said outer edge, a penetrating point, an inside front edge, an inner edge located beside the pivot axis and parallel to it, and a rear edge.

* * * * *